US011564547B2

(12) United States Patent
Lucas

(10) Patent No.: US 11,564,547 B2
(45) Date of Patent: Jan. 31, 2023

(54) CLEANING PAD FOR AN AUTONOMOUS CLEANING ROBOT

(71) Applicant: iRobot Corporation, Bedford, MA (US)

(72) Inventor: Brian Lucas, Marblehead, MA (US)

(73) Assignee: iRobot Corporation, Bedford, MA (US)

( * ) Notice: Subject to any disclaimer, the term of this patent is extended or adjusted under 35 U.S.C. 154(b) by 460 days.

(21) Appl. No.: 16/536,815

(22) Filed: Aug. 9, 2019

(65) Prior Publication Data

US 2020/0345197 A1 Nov. 5, 2020

Related U.S. Application Data

(60) Provisional application No. 62/840,773, filed on Apr. 30, 2019.

(51) Int. Cl.

| | |
|---|---|
| ***A47L 11/40*** | (2006.01) |
| ***A47L 11/10*** | (2006.01) |
| *A47L 11/38* | (2006.01) |

(52) U.S. Cl.

CPC ..... *A47L 11/4036* (2013.01); *A47L 11/10* (2013.01); *A47L 11/38* (2013.01)

(58) Field of Classification Search

CPC ..... A47L 11/10; A47L 11/38; A47L 11/4036; A47L 11/4038; A47L 13/16; A47L 13/44

See application file for complete search history.

(56) References Cited

U.S. PATENT DOCUMENTS

| | | | | |
|---|---|---|---|---|
| 3,148,404 | A | 9/1964 | Jensen | |
| 5,071,489 | A | 12/1991 | Silvenis et al. | |
| 6,101,661 | A | 8/2000 | Policicchio et al. | |
| 6,766,552 | B1 * | 7/2004 | Policicchio | A47L 13/16 15/228 |
| 6,996,871 | B1 | 2/2006 | Policicchio et al. | |
| 7,962,993 | B2 * | 6/2011 | Glaug | D04H 1/407 15/228 |
| 8,291,542 | B2 * | 10/2012 | Wildeman | D04B 21/165 15/244.3 |

(Continued)

FOREIGN PATENT DOCUMENTS

| | | | | |
|---|---|---|---|---|
| CA | 2527510 A1 * | 12/2004 | | A47L 13/16 |
| CN | 101711660 | 5/2010 | | |

(Continued)

OTHER PUBLICATIONS

International Search Report and Written Opinion in International Appln. No. PCT/US2020/28124, dated Jul. 24, 2020, 11 pages.

(Continued)

*Primary Examiner* — Marc Carlson

(74) *Attorney, Agent, or Firm* — Fish & Richardson P.C.

(57) ABSTRACT

A cleaning pad includes a mounting surface disposed on a top side of the cleaning pad. The mounting surface is configured to provide a mechanical connection to an autonomous cleaning robot. The cleaning pad includes a first outer layer disposed on a bottom side of the cleaning pad, the first outer layer having a first coefficient of friction; and a second outer layer disposed on the bottom side of the cleaning pad, the second outer layer having a second coefficient of friction less than the first coefficient of friction.

33 Claims, 10 Drawing Sheets

(56) References Cited

U.S. PATENT DOCUMENTS

| | | | | |
|---|---|---|---|---|
| 9,032,577 | B2 * | 5/2015 | Colangelo | A47L 25/00 15/104.93 |
| 9,204,775 | B2 | 12/2015 | Pung et al. | |
| 2004/0068817 | A1 * | 4/2004 | Policicchio | A47L 13/51 15/228 |
| 2004/0128786 | A1 * | 7/2004 | Policicchio | B08B 1/00 15/228 |
| 2005/0015913 | A1 | 1/2005 | Kim et al. | |
| 2005/0022843 | A1 * | 2/2005 | Policicchio | A47L 13/16 134/6 |
| 2005/0215459 | A1 | 9/2005 | Policicchio et al. | |
| 2005/0268418 | A1 | 12/2005 | Tanaka | |
| 2007/0077834 | A1 * | 4/2007 | Hanson | D04H 1/4374 442/59 |
| 2007/0259580 | A1 | 11/2007 | Hernandez et al. | |
| 2010/0306946 | A1 * | 12/2010 | Pung | A47L 13/16 15/209.1 |
| 2013/0111682 | A1 * | 5/2013 | Pung | B32B 3/30 15/118 |
| 2014/0245556 | A1 * | 9/2014 | Kaminer | A47L 11/284 15/228 |
| 2015/0128364 | A1 * | 5/2015 | Dooley | B32B 25/14 15/98 |
| 2016/0242613 | A1 | 8/2016 | Dooley et al. | |
| 2017/0095132 | A1 * | 4/2017 | Tollens | A47L 13/256 |
| 2017/0095133 | A1 * | 4/2017 | Hoying | B32B 5/06 |
| 2017/0095134 | A1 * | 4/2017 | Hoying | A47L 13/16 |
| 2017/0164797 | A1 | 6/2017 | Abramson et al. | |
| 2017/0181595 | A1 * | 6/2017 | Hoying | B32B 5/18 |
| 2018/0079994 | A1 * | 3/2018 | Parsons | C11D 1/721 |
| 2018/0119071 | A1 * | 5/2018 | Parsons | C11D 17/0008 |
| 2018/0140154 | A1 * | 5/2018 | Tai | A47L 11/4036 |
| 2018/0160875 | A1 * | 6/2018 | Song | A61F 13/5125 |
| 2018/0289234 | A1 * | 10/2018 | Policicchio | A47L 13/20 |
| 2018/0344117 | A1 | 12/2018 | Williams et al. | |
| 2019/0059680 | A1 | 2/2019 | Fox et al. | |

FOREIGN PATENT DOCUMENTS

| | | |
|---|---|---|
| CN | 204863015 | 12/2015 |
| CN | 108968831 | 12/2018 |
| CN | 212261276 | 1/2021 |
| EP | 2631065 | 8/2013 |
| KR | 20160123799 | 10/2016 |

OTHER PUBLICATIONS

U.S. Appl. No. 12/429,963, filed Apr. 24, 2009, Dooley et al.
U.S. Appl. No. 12/930,260, filed Dec. 30, 2010, Chaudhry.
U.S. Appl. No. 14/077,296, filed Nov. 12, 2013, Dooley et al.
U.S. Appl. No. 14/583,349, filed Dec. 25, 2014, Okamoto et al.
U.S. Appl. No. 16/117,416, filed Aug. 30, 2018, Lu.
U.S. Appl. No. 16/205,611, filed Nov. 30, 2018, Reimels.
"Braava Floor Mopping Robot: 300 Series Owner's Manual," iRobot Corp., Copyright 2008-2017, 28 pages.
"Braava Jet Owner's Guide," iRobot Corp., Copyright 2016-2017, 25 pages.
"Scooba 400 Series Owner's Manual," iRobot Corp., (undated), 32 pages.
International Preliminary Report on Patentability in International Appln. No. PCT/US2020/028124, dated Nov. 11, 2021, 9 pages.

* cited by examiner

CLEANING PAD FOR AN AUTONOMOUS CLEANING ROBOT

CLAIM OF PRIORITY

This application claims priority to U.S. Patent Application Ser. No. 62/840,773, filed on Apr. 30, 2019, the contents of which are incorporated here by reference in their entirety.

BACKGROUND

Cleaning robots include mobile robots that autonomously perform cleaning tasks within an environment, e.g., a home. Many kinds of cleaning robots are autonomous to some degree and in different ways. The cleaning robots include a controller that is configured to autonomously navigate the cleaning robot about the environment such that the cleaning robot can ingest debris as it moves.

SUMMARY

Certain cleaning robots can include a cleaning pad. The cleaning pad can be mounted on an underside of the cleaning robot and can collect debris during a cleaning mission of the cleaning robot. In certain situations, dust bunnies can accumulate in front of the cleaning pad. Dust bunnies most commonly occur in areas not frequently cleaned (e.g., underneath furniture) and can include collections of hair and/or lint. The accumulated dust bunnies can interfere with the normal operation of cleaning robot sensors, such as by occluding the cleaning robot sensors. The inventors have recognized, among other things, that it may be possible to provide a cleaning pad that can mitigate the accumulation of dust bunnies in front of the cleaning pad during a cleaning mission of the cleaning robot, such as to reduce interference with the cleaning robot sensors.

In an aspect, a cleaning pad includes a mounting surface disposed on a top side of the cleaning pad. The mounting surface is configured to provide a mechanical connection to an autonomous cleaning robot. The cleaning pad includes a first outer layer disposed on a bottom side of the cleaning pad, the first outer layer having a first coefficient of friction; and a second outer layer disposed on the bottom side of the cleaning pad, the second outer layer having a second coefficient of friction less than the first coefficient of friction.

Embodiments can include one or more of the following features.

A surface area of the first outer layer is larger than a surface area of the second outer layer. A ratio of the surface area of the first outer layer to the surface area of the second outer layer is between 1:1 and 10:1.

The second outer layer is disposed forward of at least a portion of the first outer layer.

A forward portion of the cleaning pad is angled relative to a rear portion of the cleaning pad. An angle between the forward portion of the pad and the rear portion of the pad is between 30° and 60°.

The second outer layer includes a layer of material wrapped around a forward edge of the cleaning pad.

The cleaning pad includes a core, in which the mounting surface is disposed on a top surface of the core and the first and second outer layers are disposed on a bottom surface of the core. The first outer layer includes a layer of material wrapped around the core. The first outer layer is disposed directly on the bottom surface of the core, and the second outer layer is disposed on a forward portion of the first outer layer. The first outer layer is disposed directly on a rear portion of the bottom surface of the core, and the second layer is disposed directly on a forward portion of the bottom surface of the core.

The second outer layer includes a polymer, such as a polymer layer having a release coating.

The second outer layer includes a tape.

The second outer layer includes a thin film coating.

The second outer layer includes a folded layer of material. The folded layer of material of the second outer layer defines a rear-facing opening.

The second outer layer spans an entire width of the cleaning pad.

A thickness of a forward segment of the cleaning pad is greater than a thickness of a rear segment of the cleaning pad.

A depression is defined in a bottom surface of the cleaning pad to a rear of the second outer layer.

The second coefficient of friction is less than half of the first coefficient of friction.

In an aspect, an autonomous cleaning robot includes a robot body including a forward portion and a rear portion; a drive system to maneuver the robot body across a floor surface; a cleaning assembly affixed to the forward portion of the robot body, the cleaning assembly including a pad holder; and a cleaning pad affixed to the pad holder of the cleaning assembly by a mounting surface of the cleaning pad. The mounting surface of the cleaning pad is disposed on a top side of the cleaning pad. The cleaning pad includes a first outer layer disposed on a bottom side of the cleaning pad, the first outer layer having a first coefficient of friction; and a second outer layer disposed on the bottom side of the cleaning pad, the second outer layer having a second coefficient of friction less than the first coefficient of friction.

Embodiments can include one or more of the following features.

A leading edge of the cleaning pad is aligned with a leading edge of the robot body.

A surface area of the first outer layer of the cleaning pad is larger than a surface area of the second outer layer.

The second outer layer of the cleaning pad is disposed forward of at least a portion of the first outer layer.

A forward portion of the cleaning pad is angled relative to a rear portion of the cleaning pad.

The second outer layer includes a layer of material wrapped around a forward edge of the cleaning pad.

The cleaning pad includes a core, in which the mounting surface is disposed on a top surface of the core and the first and second outer layers are disposed on a bottom surface of the core. The first outer layer is disposed directly on the bottom surface of the core, and the second outer layer is disposed on a forward portion of the first outer layer.

The second coefficient of friction is less than half of the first coefficient of friction.

The details of one or more implementations are set forth in the accompanying drawings and the description below. Other features and advantages will be apparent from the description and drawings, and from the claims.

DETAILED DESCRIPTION

Described herein is a cleaning pad for an autonomous cleaning robot that includes a low-friction layer at a forward portion of the cleaning pad and a fibrous layer at a rear portion of the cleaning pad. The presence of the low-friction layer helps to reduce the accumulation of debris, such as dust or pet hair, at or near a leading edge of the cleaning pad. The leading edge of the cleaning pad is positioned near cliff sensors of the autonomous cleaning robot, which detect flooring height changes, e.g., to prevent the autonomous cleaning robot from falling down a drop, such as a stair. By reducing the accumulation of debris in the vicinity of the cliff sensors, the functioning of the cliff sensors can be reliable and robust to a range of floor cleanliness conditions, and the structural integrity of the autonomous cleaning robot can be protected against damage from falls.

Figure 1:
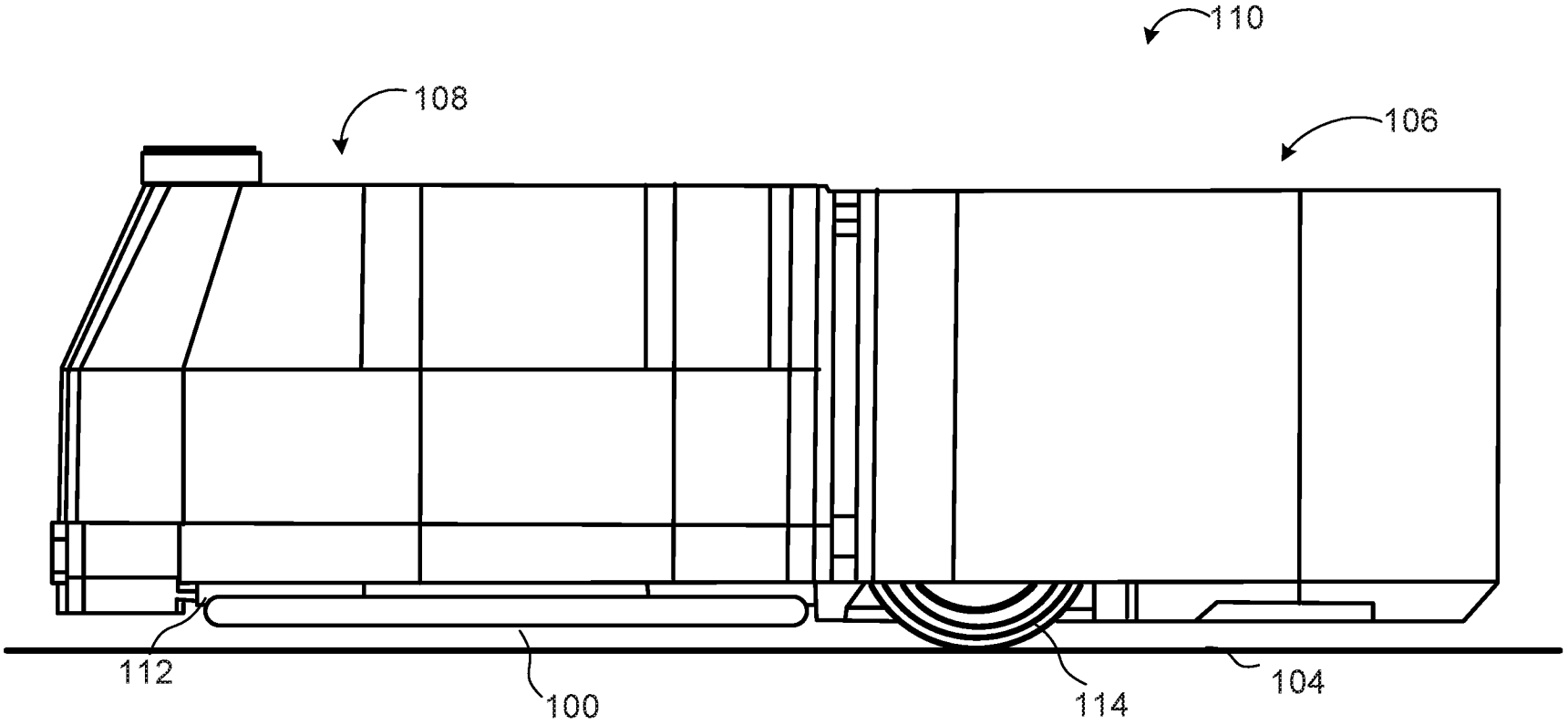
FIG. 1 is a diagram of an autonomous cleaning robot.

Referring to FIG. 1, a cleaning pad 100 is attached to an example autonomous cleaning robot 110. A drive system maneuvers the autonomous cleaning robot 110 is across a floor surface 104. Wheels 114 support a rear portion 106 of the autonomous cleaning robot 110, and the cleaning pad 100 supports a forward portion 108 of the autonomous cleaning robot 110. As the autonomous cleaning robot 110 navigates the floor surface 104, the cleaning pad 100 contacts the floor surface 104, providing cleaning functionality, such as wet mopping or dry cleaning functionality. The cleaning pad 100 is reversibly attached to a pad holder 112 of the autonomous cleaning robot 110, e.g., such that the cleaning pad 100 can be replaced after the autonomous cleaning robot 110 completes execution of a cleaning mission or when the cleaning pad 100 becomes soiled. The cleaning pad 100 can be a disposable cleaning pad or a reusable cleaning pad.

Figure 2:
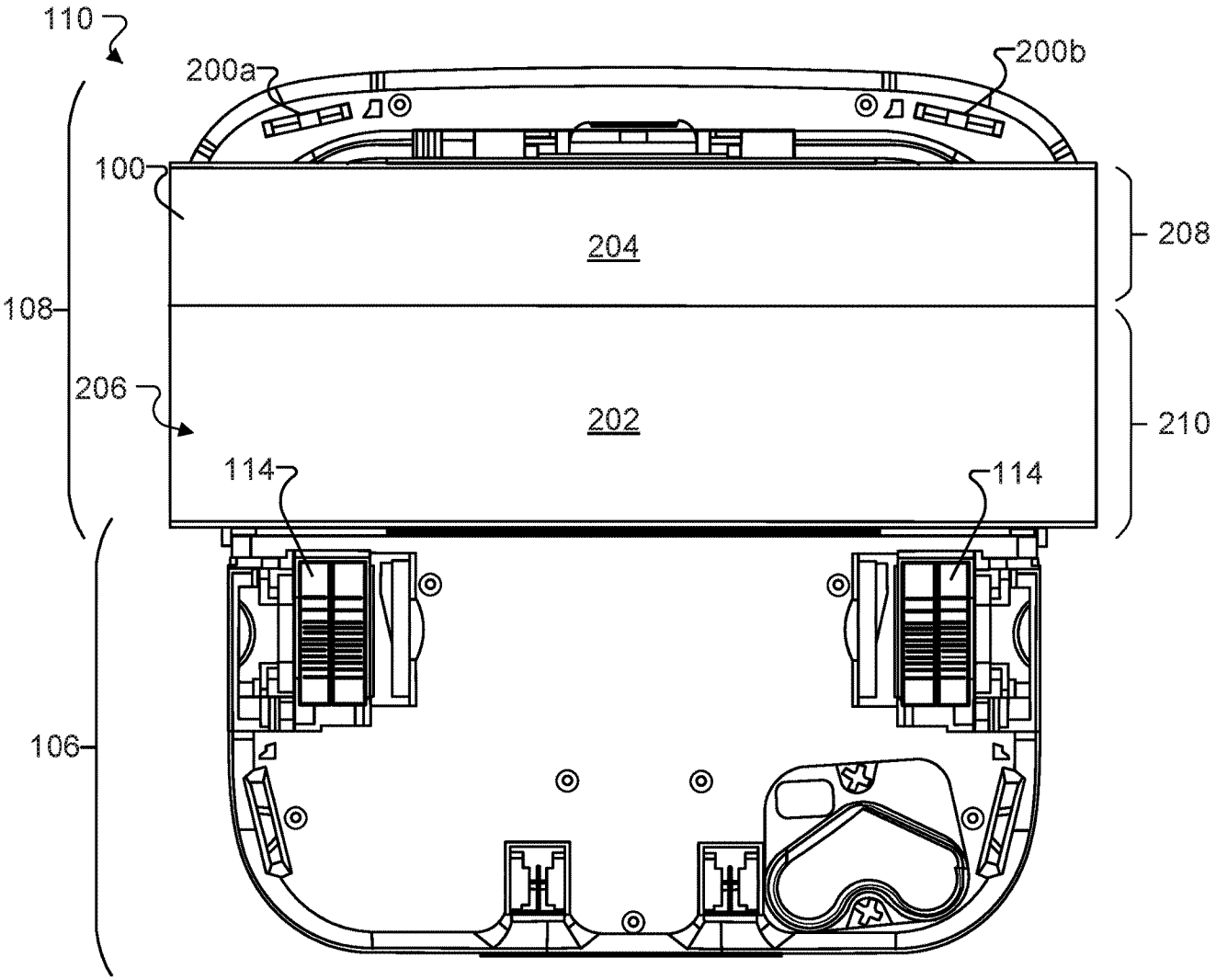
FIG. 2 is a bottom view of an autonomous cleaning robot.

FIG. 2 shows a bottom view of the autonomous cleaning robot 110. The cleaning pad 100 is disposed toward the forward portion 108 of the autonomous cleaning robot 110 to provide cleaning functionality as the autonomous cleaning robot navigates the floor surface.

The autonomous cleaning robot 110 includes forward cliff sensors 200*a*, 200*b* (collectively cliff sensors 200) disposed in the forward corners of the autonomous cleaning robot 110. The cliff sensors 200 can be mechanical drop sensors or light based proximity sensors, such as an IR (infrared) pair, a dual emitter-single receiver, or dual receiver-single emitter IR light-based proximity sensor aimed downward at the floor surface. The cliff sensors 200 span between sidewalls of the autonomous cleaning robot 110 and cover the corners closely to detect flooring height changes beyond a threshold accommodated by reversible robot wheel drop prior to traversal of the respective floor portions by the autonomous cleaning robot 110. For example, the placement of the cliff sensors 200 proximate the corners of the autonomous cleaning robot 110 helps to ensure that the cliff sensors 200 trigger when the autonomous cleaning robot 110 overhangs a flooring drop, preventing the robot wheels 114 from advancing over the drop edge.

The example autonomous cleaning robot 110 includes one forward cliff sensor 200*a*, 200*b* in each forward corner. In some examples, an autonomous cleaning robot can include only a single forward cliff sensor, or can include two or more cliff sensors. In some examples, an autonomous cleaning robot can include one or more rear cliff sensors disposed in the rear portion 106 of the autonomous cleaning robot 110, e.g., in one or more of the rear corners.

As the autonomous cleaning robot 110 navigates the floor surface to execute a dry cleaning mission, a forward portion 208 of the cleaning pad 100 crosses the floor surface before a rear portion 210 of the cleaning pad 100, when the autonomous cleaning robot 110 is moving in a forward direction. For some cleaning pads, during a cleaning mission, debris from the floor surface can build up on the forward portion of the cleaning pad that is attached to the autonomous cleaning robot. For instance, debris, such as dust bunnies or pet hair, can become ensnared in a leading edge of the cleaning pad. In some cases, the debris buildup can be significant enough to occlude one or more of the forward cliff sensors 200, which can hinder the ability of the cliff sensors 200 to detect flooring height changes.

To help prevent buildup of debris at the forward portion 208 of the cleaning pad 100, a low-friction layer 204 is disposed at the forward portion 208 of the cleaning pad 100. A fibrous layer 202 is disposed at a rear portion 210 of the cleaning pad 100. The coefficient of friction between the low-friction layer 204 and debris is less than a coefficient of friction between the fibrous layer 202 and debris. For simplicity, the coefficient of friction between the low-friction layer 204 and debris is sometimes referred to as just the coefficient of friction of the low-friction layer 204, and the coefficient of friction between the fibrous layer 202 and debris is sometimes referred to as just the coefficient of friction of the fibrous layer 202. The low-friction layer 204 and the fibrous layer 202 are substantially coplanar, e.g., at least portions of both the low-friction layer 204 and the fibrous layer 202 are disposed on a bottom surface 206 of the cleaning pad 100.

Figure 3A:
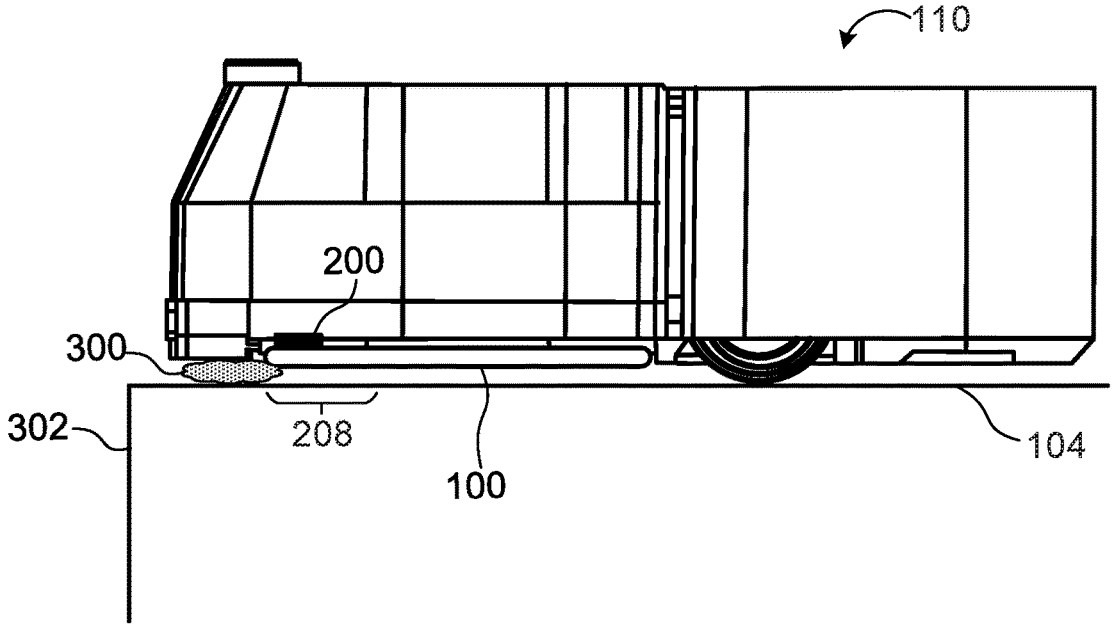
FIGS. 3A and 3B are diagrams of an autonomous cleaning robot in the vicinity of a cliff.
Figure 3B:
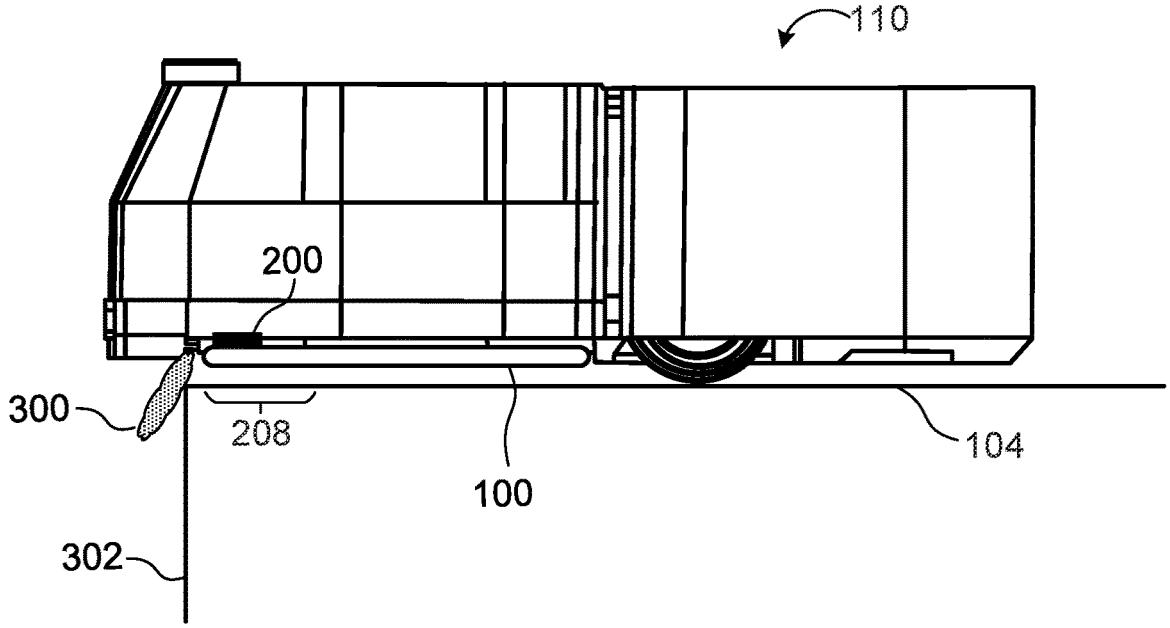

For some debris, the coefficient of friction between the debris and the floor surface is higher than the coefficient of friction between the debris and the low-friction layer 204. Moreover, the coefficient of friction between the debris and the floor surface can be lower than the coefficient of friction between the debris and the fibrous layer 202. In such instances, the debris will slip past the forward portion 208 of the cleaning pad 100, accumulating at the rear portion 210 of the cleaning pad 100, where it does not block the functioning of the cliff sensors. As the low-friction layer 204 of the cleaning pad 100 moves over the debris, the debris is compressed by the pressure applied on the floor surface by the cleaning pad 100. When the fibrous layer 202 passes over the debris, the debris accumulates at the fibrous layer 202, e.g., the debris is ensnared in fibers of the fibrous layer, keeping the cliff sensors 200 clear. In some examples, the forward portion 208 of the cleaning pad 100 is thicker than the rear portion 210 of the cleaning pad 100 to facilitate compression of debris as the cleaning pad 100 passes over the debris. Referring to FIGS. 3A and 3B, for some debris 300, the coefficient of friction between the debris 300 and the floor surface 104 is relatively low, or the debris 300 is too large to slip between the cleaning pad 100 and the floor surface 104. Such debris 300 can build up at the forward portion 208 of the cleaning pad 100, as shown in FIG. 3A. However, because the forward portion 208 of the cleaning pad 100, e.g., the leading edge of the cleaning pad 100, is formed of a slick, low-friction material, the accumulated debris is not ensnared in the cleaning pad. When the autonomous cleaning robot 110 navigates to the vicinity of a cliff 302, the accumulated debris 300 can drop away from the autonomous cleaning robot 110, as shown in FIG. 3B, freeing the cliff sensors 200 to detect the cliff 302 before the autonomous cleaning robot 110 navigates past the edge of the cliff 302.

Figure 4A:
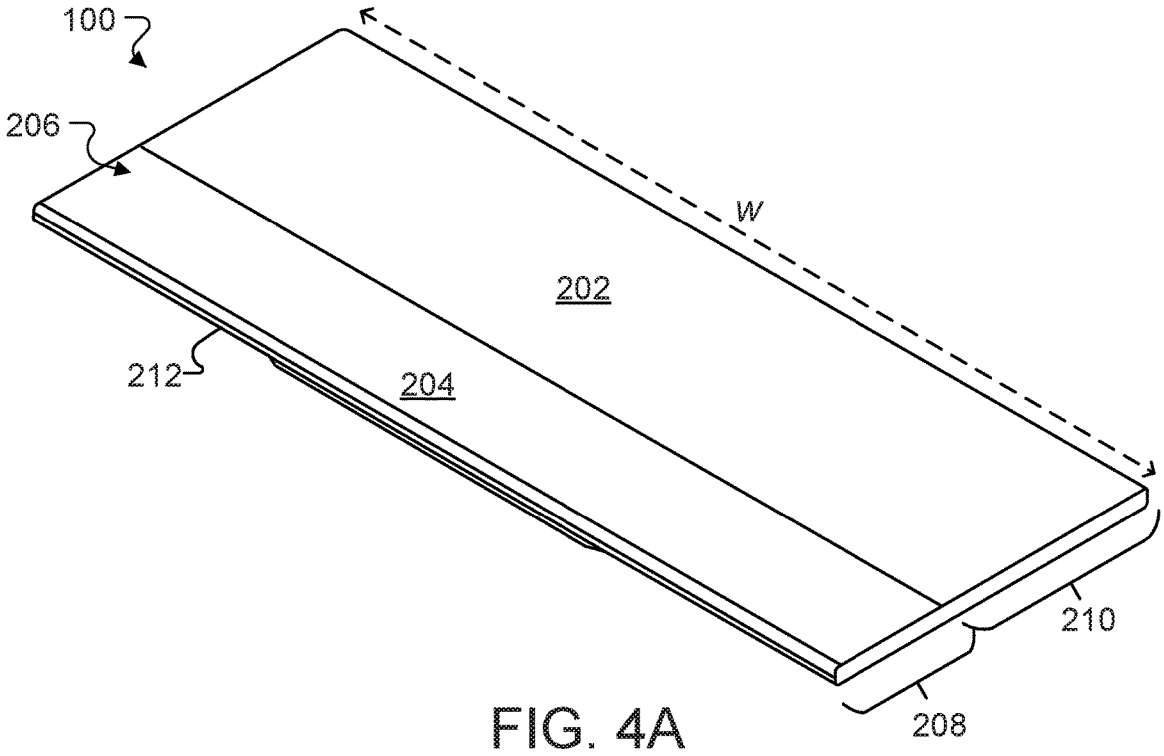
FIGS. 4A and 4B are a bottom and a top view, respectively, of a cleaning pad.
Figure 4B:
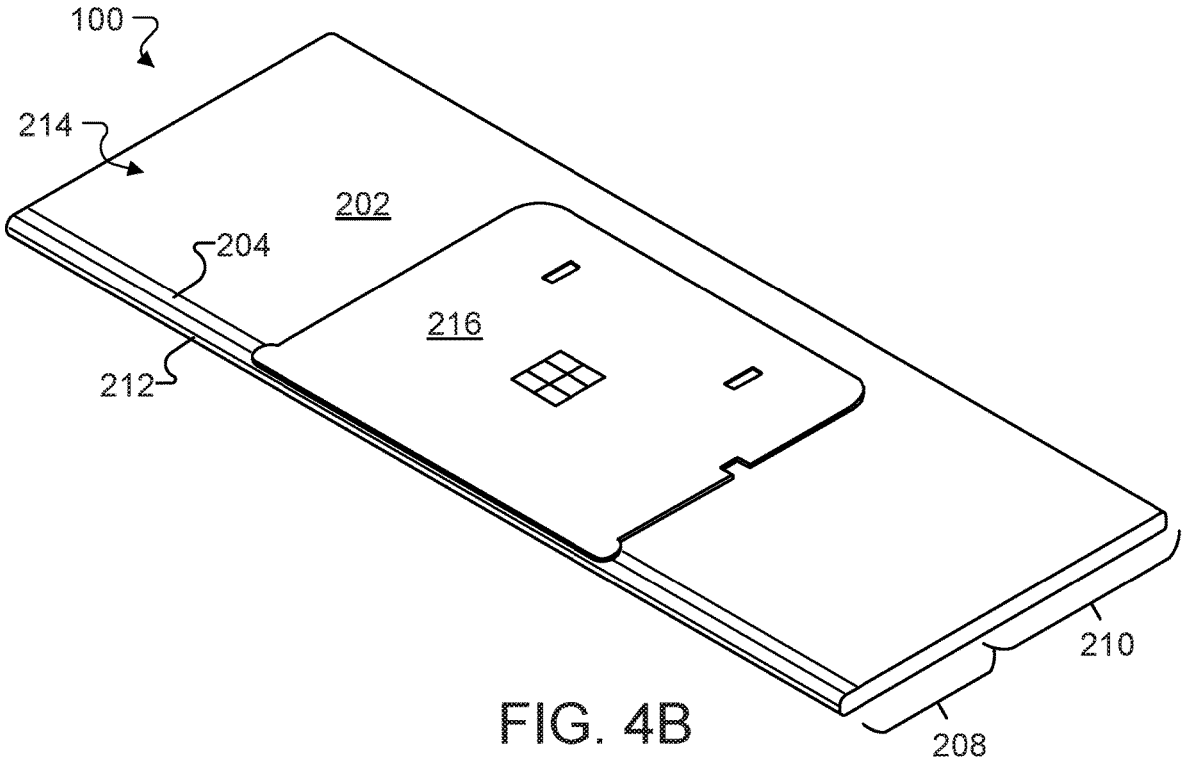

FIGS. 4A and 4B are bottom and top views, respectively, of the cleaning pad 100. The low-friction layer 204 is disposed at the forward portion 208 of the cleaning pad 100 and the fibrous layer 202 is disposed at the rear portion 210 of the cleaning pad 100. In some examples, the low-friction layer 204 and the fibrous layer 202 are adjacent to one another. In some examples, the fibrous layer 202 extends toward the forward portion 208 of the cleaning pad 100 such that the low-friction layer 204 is disposed on a forward portion of the fibrous layer 202. For instance, the fibrous layer 202 can cover the entire bottom surface 206 of the cleaning pad 100, with the low-friction layer 204 being disposed on the forward portion of the bottom surface.

The coefficient of friction between the low-friction layer 204 and debris on the floor surface is less than the coefficient of friction between the fibrous layer 202 and the debris. For instance, the coefficient of friction between the low-friction layer 204 and debris can be between about 10% and about 60% of the coefficient of friction between the fibrous layer 202 and the debris, e.g., between about 20% and about 50%, e.g., between about 30% and about 50%. For instance, the coefficient of friction between the fibrous layer 202 and debris can be between about 1.0 and about 1.4, and the coefficient of friction between the low-friction layer 204 and debris can be between about 0.2 and about 0.6.

The fibrous layer 202 can be a fibrous, non-woven material. The low-friction layer 204 can be a woven material, such as a satin or satin-like material. The low-friction layer 204 can include a polymer, such as polyethylene terephthalate (PET) or polytetrafluoroethylene (PTFE). In some examples, the low-friction layer 204 can be a polymer layer having a release coating, e.g., a silicone release coating.

In the example cleaning pad 100, the fibrous layer 202 and the low-friction layer 204 both span a width w of the cleaning pad 100. A surface area of the fibrous layer 202 (e.g., the surface area of the fibrous layer 202 on the bottom surface 206 of the cleaning pad 100) is equal to or greater than a surface area of the low-friction layer 204 (e.g., the surface area of the low-friction layer 204 on the bottom surface 206 of the cleaning pad 100). For instance, a ratio of the surface area of the fibrous layer 202 to the surface area of the low-friction layer 204 can be between about 1:1 and about 10:1, e.g., between about 2:1 and about 5:1, e.g., about 2:1, about 3:1, about 4:1, or about 5:1. The ratio of the surface area of the fibrous layer 202 to the surface area of the low-friction layer 204 can be such that the cleaning pad retains a substantial amount of its cleaning capabilities, which are generally provided by the fibrous layer 202, while achieving the ability to keep the cliff sensors free of debris, as provided by the low-friction layer 204.

In the cleaning pad 100, the fibrous layer 202 is wrapped around the cleaning pad 100 such that the fibrous layer 202 is also present on a top surface 214 of the cleaning pad 100 (FIG. 4B). The low-friction layer 204 is wrapped around a leading edge 212 of the cleaning pad 100 such that a portion of the low-friction layer 204 is disposed on a top surface 214 of the cleaning pad 100 (FIG. 4B). In some examples, the low-friction layer 204 is disposed only on the bottom surface 206 of the cleaning pad 100 and does not wrap around the leading edge 212 or onto the top surface 214. In some examples, the fibrous layer 202 is disposed only on the bottom surface 206 of the cleaning pad 100.

A mounting surface 216 is disposed on the top surface 214 of the cleaning pad 100 for mechanical connection to the autonomous cleaning robot. For instance, the mounting surface 216 can be shaped to be received by the pad holder 112 (FIG. 1) of the autonomous cleaning robot 110. The mounting surface 216 can be, e.g., cardstock, plastic, or another material appropriate for securing the cleaning pad 100 to the pad holder of the autonomous cleaning robot 110. When the cleaning pad 100 is mounted on the autonomous cleaning robot, the bottom surface 206 of the cleaning pad 100, including the fibrous and low-friction layers 202, 204, faces the floor surface to be cleaned.

Figure 5:
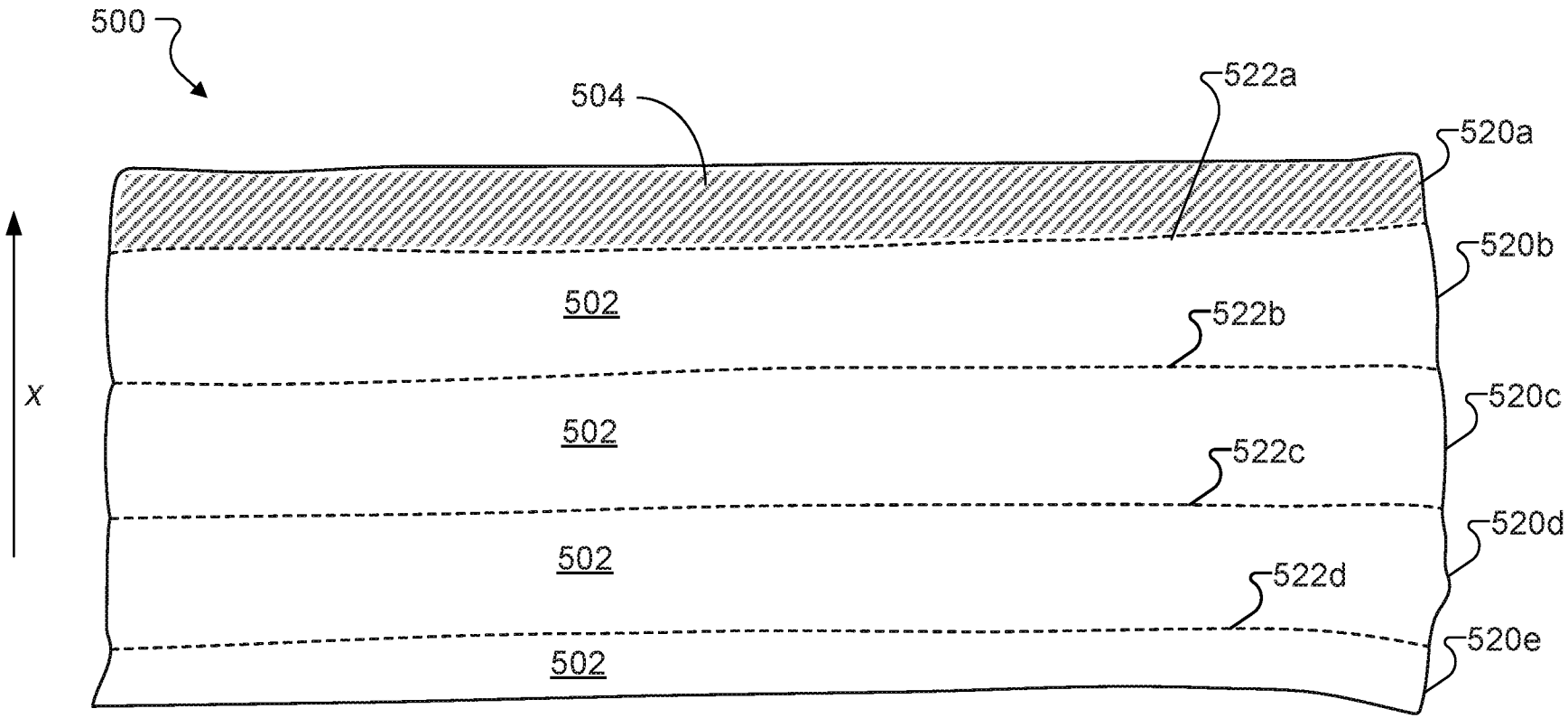
FIG. 5 is a bottom view of a cleaning pad.

Referring to FIG. 5, in some examples, a cleaning pad 500 for use with the autonomous cleaning robot 110 is composed of multiple segments 520*a*-520*e* (collectively referred to as segments 520). The cleaning pad 500 is composed of five segments, but in some examples cleaning pads can be composed of more or fewer segments. The segments 520 are defined by transition regions 522*a*-522*d* (collectively referred to as transition regions 522), each extending across the width of the cleaning pad 500. In each transition region 522, the elements of the cleaning pad 500 (e.g., one or more of core layers, discussed below; a low-friction layer, and a fibrous layer) are secured together through the thickness of the cleaning pad 500, such that the transition regions 522 to have a thickness that is less than the thickness of the segments 520 of the cleaning pad 500.

A forward segment 520*a* of the cleaning pad 500 includes a low-friction layer 504, and rear segments 520*b*-520*e* of the cleaning pad 500 include a fibrous layer 502. The low friction layer 504 has a lower coefficient of friction than the fibrous layer 502, e.g., as described above for the layers 202, 204 of FIG. 4. In some examples, multiple segments include the low-friction layer 504.

In some examples, the forward segment 520*a* of the cleaning pad 500 is thicker than one or more of the rear segments 520*b*-520*e*, e.g., to facilitate compression of debris by the cleaning pad 500. In some examples, one or more segments, e.g., the second segment 520*b*, of the cleaning pad 500 are thinner than the forward segment 520*a*, to provide a volume within which debris can accumulate.

In the cleaning pad 500, the segments 520 have equal length along the direction of travel x of the cleaning pad. In some cleaning pads, one or more of the segments 520 can be longer or shorter than one or more of the other segments.

The segments 520 of the cleaning pad 500 can be formed by mechanical processing of a cleaning pad without segments, e.g., by mechanical embossing, ultrasonic welding, or other types of mechanical processing. Additional details about segmented cleaning pads can be found in U.S. Patent Application Publication No. US 2018/0344117, the contents of which are incorporated here by reference in their entirety.

Figure 6:
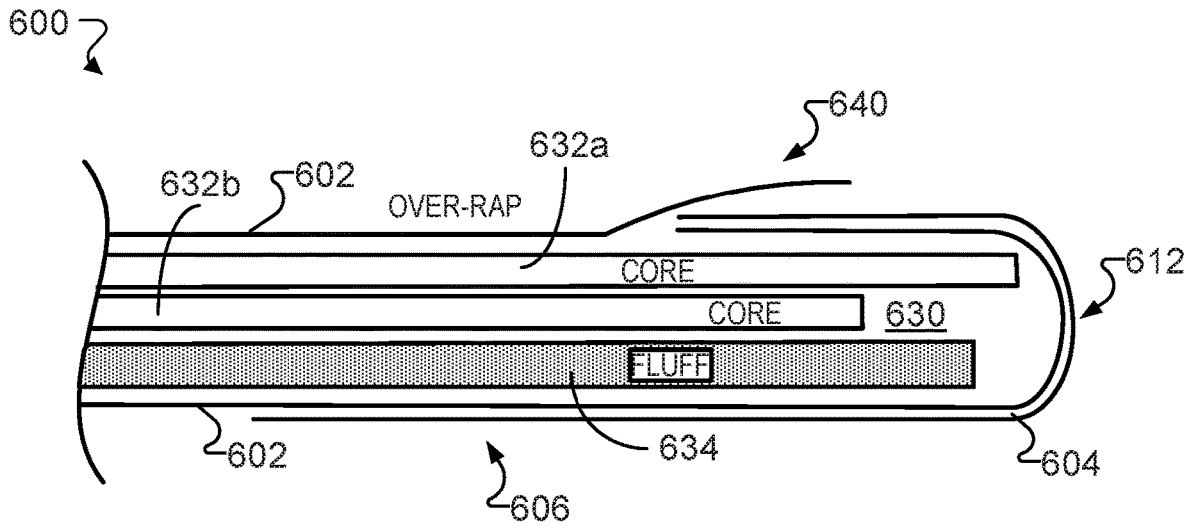
FIGS. 6-8 are cross sectional views of forward portions of cleaning pads.

FIG. 6 shows a cross section of a forward portion of an example cleaning pad 600, e.g., for use with the autonomous cleaning robot 110 of FIG. 1. For instance, the cross sectional profile shown in FIG. 6 can be a cross sectional profile of the cleaning pad 100 of FIG. 2. The cleaning pad 600 includes a core 630. A fibrous layer 602 is disposed directly on and wrapped around the core 630. A low-friction layer 604 is disposed on a forward portion of the fibrous layer 602 and wrapped around a leading edge 612 of the cleaning pad 600. For instance, the low-friction layer 604 can be a tape, a spray coating, a thin film, or another suitable form of material that is applied to the forward portion of the fibrous layer 602. In this configuration, both the fibrous layer 602 and the low-friction layer 604 are disposed on a bottom surface 606 of the cleaning pad 600. The low friction layer 604 has a lower coefficient of friction than the fibrous layer 602, e.g., as described above for the layers 202, 204 of FIG. 4. In some examples, both the fibrous layer 602 and the low-friction layer 604 are disposed directly on the core 630, with the fibrous layer 602 being disposed directly on a rear portion of the core 630 and the low-friction layer 604 being disposed directly on a forward portion of the core 630.

In the cleaning pad 600, the fibrous layer 602 is wrapped around the entire surface of the core 630, forming an overlap region 640 on the top surface of the cleaning pad 600 in which the fibrous layer 602 overlaps both itself and the low-friction layer 604. The presence of the overlap region 640 lends mechanical stability to the structure of the cleaning pad 600 and prevents the low-friction layer 604 from peeling loose from the surface of the cleaning pad 600.

The core 630 of the cleaning pad 600 includes multiple sub-layers, including a top structural layer 632*a*, a bottom structural layer 632*b*, and a compressible layer 634. In some examples, the core 630 can include additional sub-layers. In some examples, the core 630 can be a single layer of material.

Figure 7:
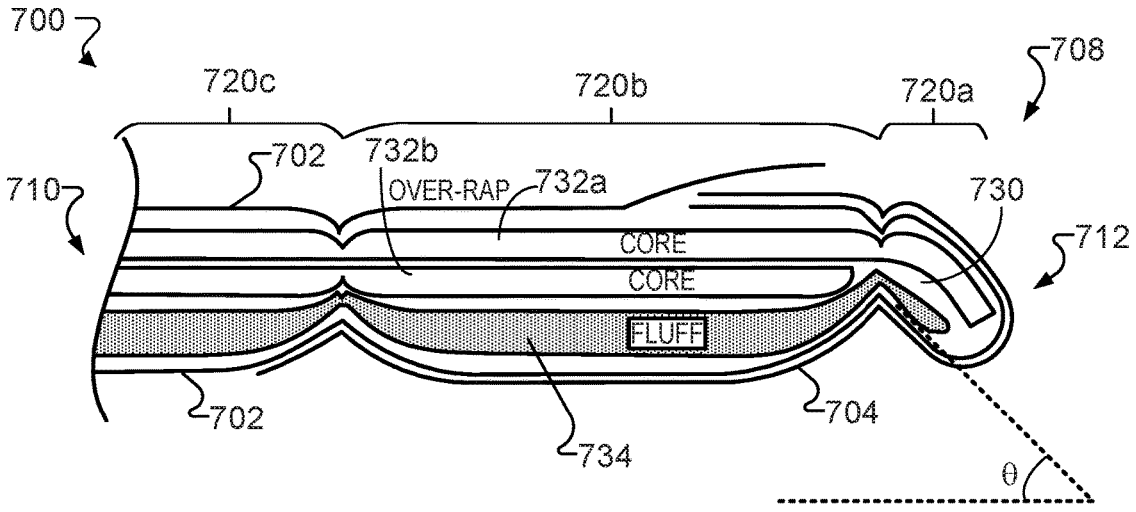

FIG. 7 shows a cross section of a forward portion of an example cleaning pad 700, e.g., for use with the autonomous cleaning robot 110 of FIG. 1. The cleaning pad 700 is composed of multiple segments 720*a*-720*c* (collectively referred to as segments 720). For instance, the cross sectional profile shown in FIG. 7 can be a cross sectional profile of the cleaning pad 500 of FIG. 5.

The cleaning pad 700 includes a core 730 that includes multiple sub-layers, including a top structural layer 732*a*, a bottom structural layer 732*b*, and a compressible layer 734. The top structural layer 732*a* extends further forward than the bottom structural layer 732*b*.

A fibrous layer 702 is disposed directly on and wrapped around the core 730. A low-friction layer 704 is disposed on the fibrous layer 702 at a forward segment 720*a* of the cleaning pad 700, and wrapped around a leading edge 712 of the cleaning pad 700. In some examples, both the fibrous layer 702 and the low-friction layer 704 are disposed directly on the core 730. The low friction layer 704 has a lower coefficient of friction than the fibrous layer 702, e.g., as described above for the layers 202, 204 of FIG. 4.

The process of forming the segments 720 in the cleaning pad 700 causes a tension force to be applied to the fibrous layer 702 and low-friction layer 704 on the bottom surface of the cleaning pad 700 because of the difference in length between the top and bottom structural layers 732*a*, 732*b* of the core 730. The tension on the layers 702, 704 pulls the longer top structural layer 732*a* downwards, causing a forward portion 708 of the cleaning pad 700 to be angled downwards relative to a rear portion 710 of the cleaning pad 700. For instance, the angle θ of the forward portion 708 of the cleaning pad 700 relative to the plane of the cleaning pad 700 can be between about 30° and about 60°, e.g., about 45°. Having the forward portion 708 of the cleaning pad 700 angled downwards can enable the forward portion 708 of the cleaning pad 700 to act as a plow, pushing debris forward as the autonomous cleaning robot navigates over the debris.

Figure 8:
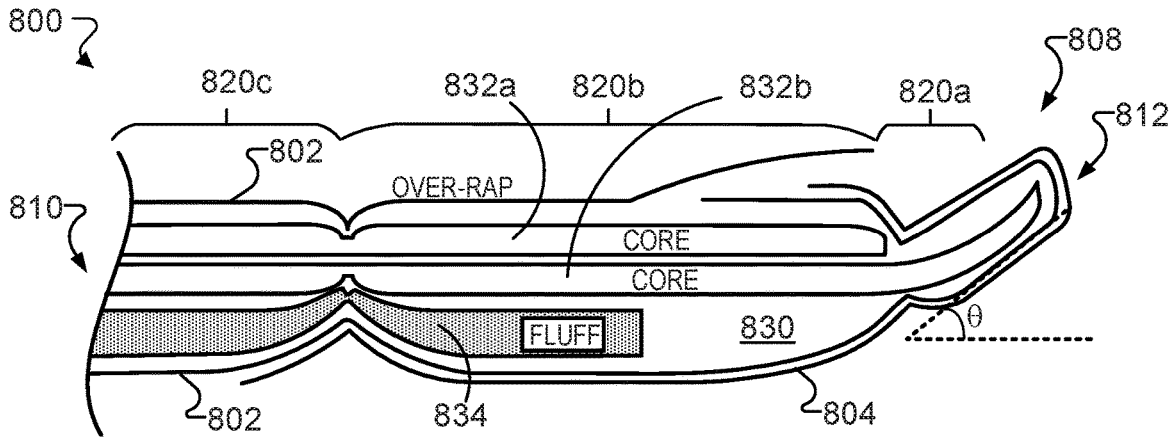

FIG. 8 shows a forward portion of an example cleaning pad 800, e.g., for use with the autonomous cleaning robot 110 of FIG. 1. The cleaning pad 800 is composed of multiple segments 820*a*-820*c* (collectively referred to as segments 820). For instance, the cross sectional profile shown in FIG. 8 can be a cross sectional profile of the cleaning pad 500 of FIG. 5.

The cleaning pad 800 includes a core 830 that has multiple sub-layers, including a top structural layer 832*a*, a bottom structural layer 832*b*, and a compressible layer 834. The bottom structural layer 832*b* extends further forward than the top structural layer 832*a*.

A fibrous layer 802 is disposed directly on and wrapped around the core 830. A low-friction layer 804 is disposed on the fibrous layer 802 at a forward segment 820*a* of the cleaning pad 800, and wrapped around a leading edge 812 of the cleaning pad 800. The low friction layer 804 has a lower coefficient of friction than the fibrous layer 802, e.g., as described above for the layers 202, 204 of FIG. 4.

The process of forming the segments 820 in the cleaning pad 800 causes a tension force to be applied to the fibrous layer 802 and low-friction layer 804 on the top surface of the cleaning pad 800 because of the difference in length between the top and bottom structural layers 832*a*, 832*b* of the core 830. the tension on the layers 802, 804 pulls the longer bottom structural layer 832*b* upwards, causing a forward portion 808 of the cleaning pad 800 to be angled upwards relative to a rear portion 810 of the cleaning pad 800. For instance, the angle θ of the forward portion 808 of the cleaning pad 800 relative to the plane of the cleaning pad 800 can be between about 30° and about 60°, e.g., about 45°. Having the forward portion 808 of the cleaning pad 800 angled upwards can enable the forward portion 808 to act as a wedge, driving debris under the cleaning pad 800, where the debris is compressed and ensnared by the fibrous layer 802.

Figure 9:
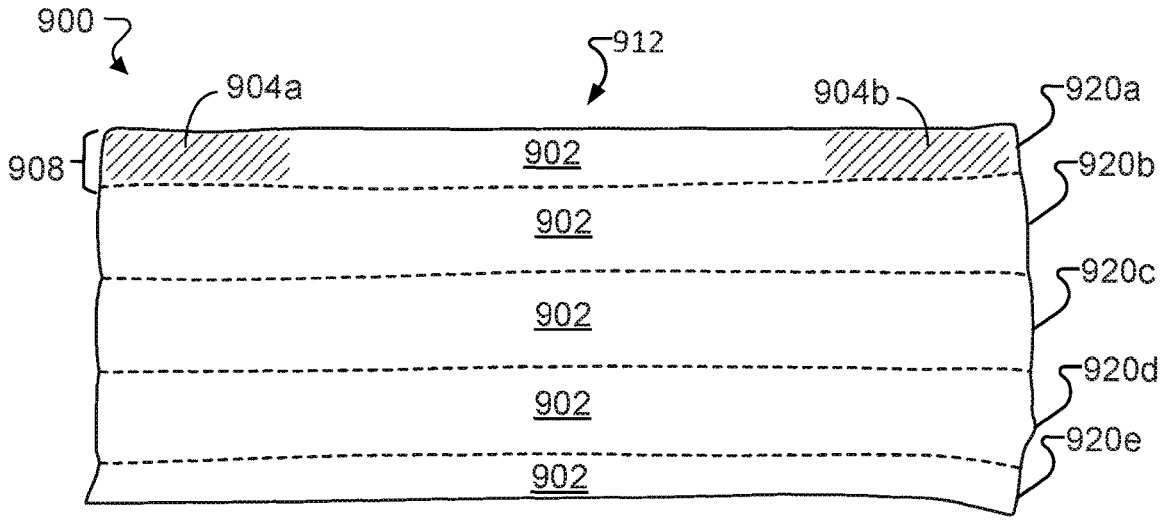
FIGS. 9 and 10 are bottom views of cleaning pads.

FIG. 9 shows a bottom view of an example cleaning pad 900, e.g., for use with the autonomous cleaning robot 110 of FIG. 1. The cleaning pad 900 has a fibrous layer 902 disposed across the entire extent of a bottom surface of the cleaning pad. For instance, the fibrous layer 902 can be wrapped around the cleaning pad. A discontinuous low-friction layer disposed on the fibrous layer 902 at a forward portion 908 of the cleaning pad 900 includes first and second low-friction regions 904*a*, 904*b* (referred to collectively as a low-friction layer 904), such that the low-friction layer 904 does not span the entire width w of the cleaning pad 900. In this configuration, a portion of a leading edge 912 of the cleaning pad 900 includes material of the low-friction layer 904, and a portion of the leading edge 912 includes material of the fibrous layer 902. The low-friction layer 904 has a coefficient of friction that is less than the coefficient of friction of the fibrous layer 902, as discussed above. The first and second low-friction regions 904 are positioned such that when the cleaning pad 900 is mounted on an autonomous cleaning robot, the first and second low-friction regions 904 are positioned generally near the forward cliff sensors of the autonomous cleaning robot.

The cleaning pad 900 of FIG. 9 has segments 920*a*-920*e*, and the first and second low-friction regions 904 occupy portions of a forward segment 920*a*. The remainder of the forward segment 920*a* is formed by the fibrous layer 902. In some examples, a cleaning pad without segments can include a discontinuous low-friction layer that does not span the entire width of the cleaning pad.

In the cleaning pad 900, the ratio of the surface area of the fibrous layer 902 to the surface area of the low-friction layer 904 can be higher than for cleaning pads in which the low-friction layer 904 extends across the entire width of the cleaning pad. For instance, the ratio of the surface area of the fibrous layer 902 to the surface area of the low-friction layer 904 can be between about 10:1 and about 20:1, enabling the cleaning pad 900 to retain more of the cleaning capabilities provided by the fibrous layer 902, while achieving the ability to keep the cliff sensors free of debris, as provided by the low-friction regions 904*a*, 904*b* aligned with the cliff sensors.

Figure 10:
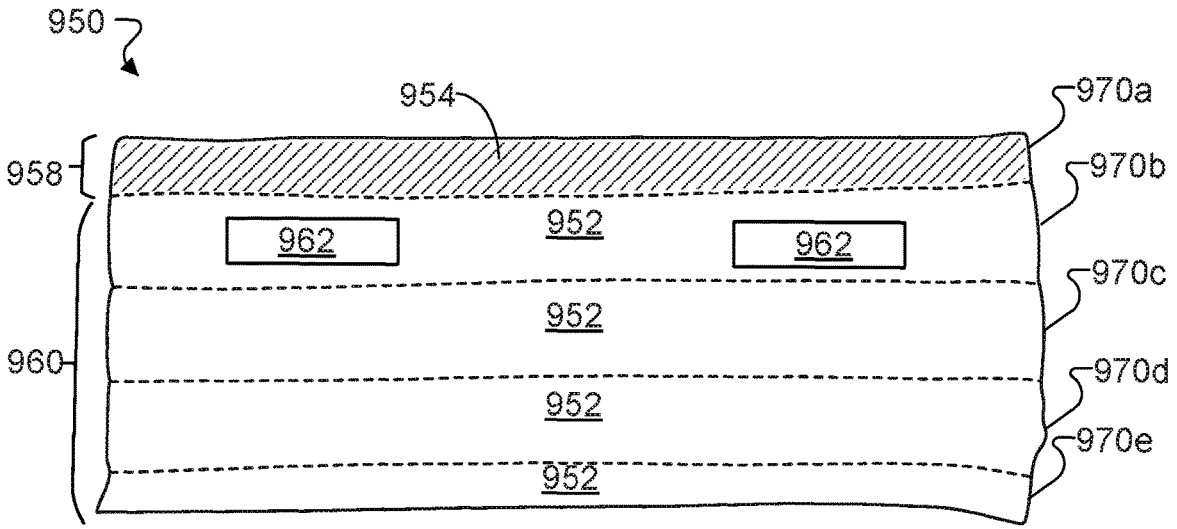

FIG. 10 shows a bottom view of an example cleaning pad 950, e.g., for use with the autonomous cleaning robot 110 of FIG. 1. A fibrous layer 952 is disposed on a rear portion 960 of a bottom surface of the cleaning pad 950, and a low-friction layer 954 is disposed on a forward portion 958 of the bottom surface of the cleaning pad 950. The low-friction layer 954 has a lower coefficient of friction than the fibrous layer 952, e.g., as described above for the layers 202, 204 of FIG. 4. Depressions 962 are formed in the bottom surface of the cleaning pad 950 to the rear of the low-friction layer 954. When an autonomous cleaning robot having the cleaning pad 950 attached thereto navigates over debris, the debris slips past the low-friction forward portion 958 of the cleaning pad 950 and accumulates in the depressions 962, keeping the bottom surface 956 of the cleaning pad 950 free to clean the floor surface.

The cleaning pad 950 of FIG. 10 has segments 970*a*-970*e*, with the depressions 962 being formed in a second segment 970*b*. In some examples, a cleaning pad without segments can have depressions formed in its bottom surface.

Figure 11A:
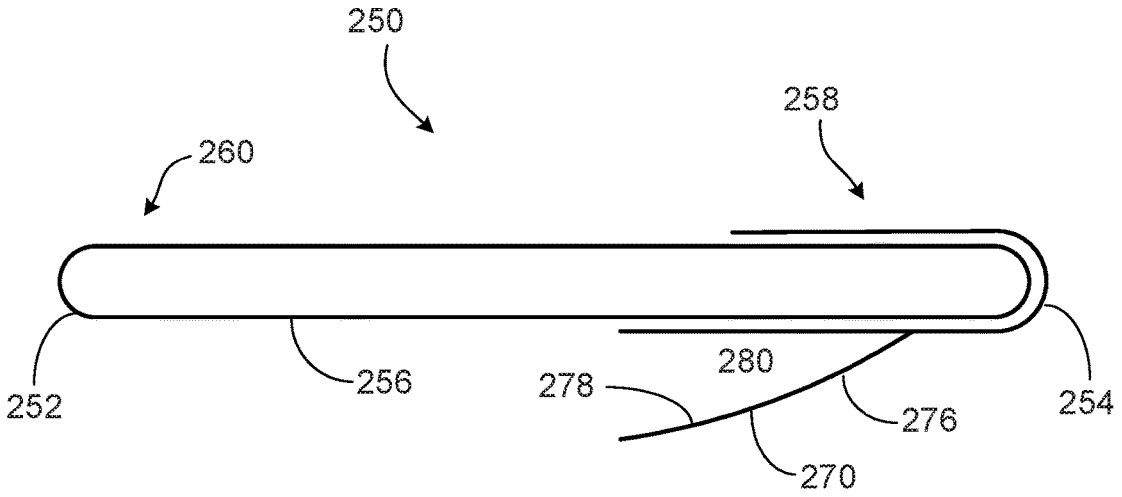
FIGS. 11A and 11B are cross sectional views of a cleaning pad.
Figure 11B:
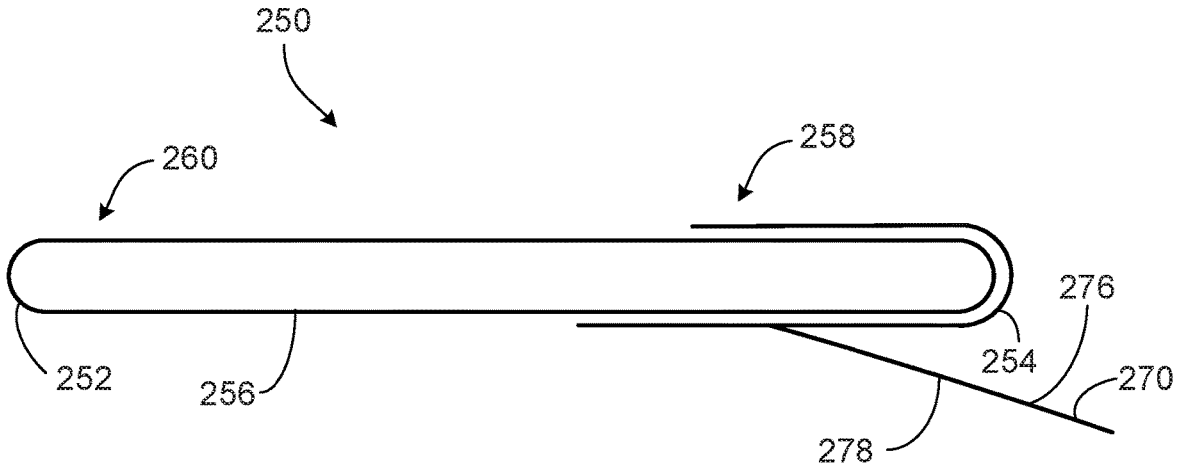

FIGS. 11A and 11B show cross sectional views of an example cleaning pad 250, e.g., for use with the autonomous cleaning robot 110 of FIG. 1. FIG. 11A shows the configuration of the cleaning pad 250 when attached to an autonomous cleaning robot that is moving forward, e.g., such that a forward portion 258 of the cleaning pad 250 contacts the floor surface before a rear portion 260 of the cleaning pad 250. FIG. 11B shows the configuration of the cleaning pad when the autonomous cleaning robot is moving in reverse, e.g., such that the rear portion 260 of the cleaning pad 250 contacts the floor surface before the forward portion 258.

The cleaning pad 250 includes a low-friction layer 254 disposed on a forward portion 258 of a bottom surface 256 of the cleaning pad 250, and a fibrous layer 252 disposed on a rear portion 260 of the bottom surface 256. The low-friction layer 254 has a lower coefficient of friction than the fibrous layer 252, e.g., as described above for the layer 202, 204 of FIG. 4. The cleaning pad 250 also includes a folded element, such as a flap 270, with a first edge 272 of the flap 270 being affixed to the low-friction layer 254 and a second edge 274 of the flap 270 being free. A first side 276 of the flap 270 is formed of the material of the low-friction layer and a second side 278 of the flap is formed of the material of the fibrous layer.

When the autonomous cleaning robot moves forward, the flap 270 is in the configuration of FIG. 11A, with the flap 270 being oriented toward the rear portion 260 of the cleaning pad 250 and a pocket 280 being defined between the flap 270 and the bottom surface 256 of the cleaning pad 250. The low-friction material on the first side 276 of the flap 270 is exposed to the floor surface such that the flap 270 functions as an element of the low-friction layer 254.

When the autonomous cleaning robot moves in reverse, the flap 270 is in the configuration of FIG. 11B, with the flap 270 being oriented toward the forward portion 258 of the cleaning pad 250. The fibrous material on the second side 278 of the flap 270 is exposed to the floor surface, such that the flap 270 ensnares debris that would otherwise move toward the forward portion 258 of the cleaning pad 250. When the autonomous cleaning robot again moves forward, the pocket 280 confines the debris ensnared by the second side 278 of the flap 270, preventing that debris from interfering with the operation of the cliff sensors.

In some examples, the low-friction layer of a cleaning pad can provide mechanical stability to the cleaning pad. For instance, some fibrous layers can be stretchable, and some low-friction layers can be substantially less stretchable, e.g., the material of the low-friction layers can have a higher elastic modulus than the material of the fibrous layers. The presence of the low-friction layer can provide a measure of resistance to stretching of the cleaning pad, e.g., stretching along the direction of motion of the autonomous cleaning robot. In some examples, the low-friction layer can be disposed on all or a portion of the top surface of a cleaning pad to provide rigidity against stretching.

Figure 12:
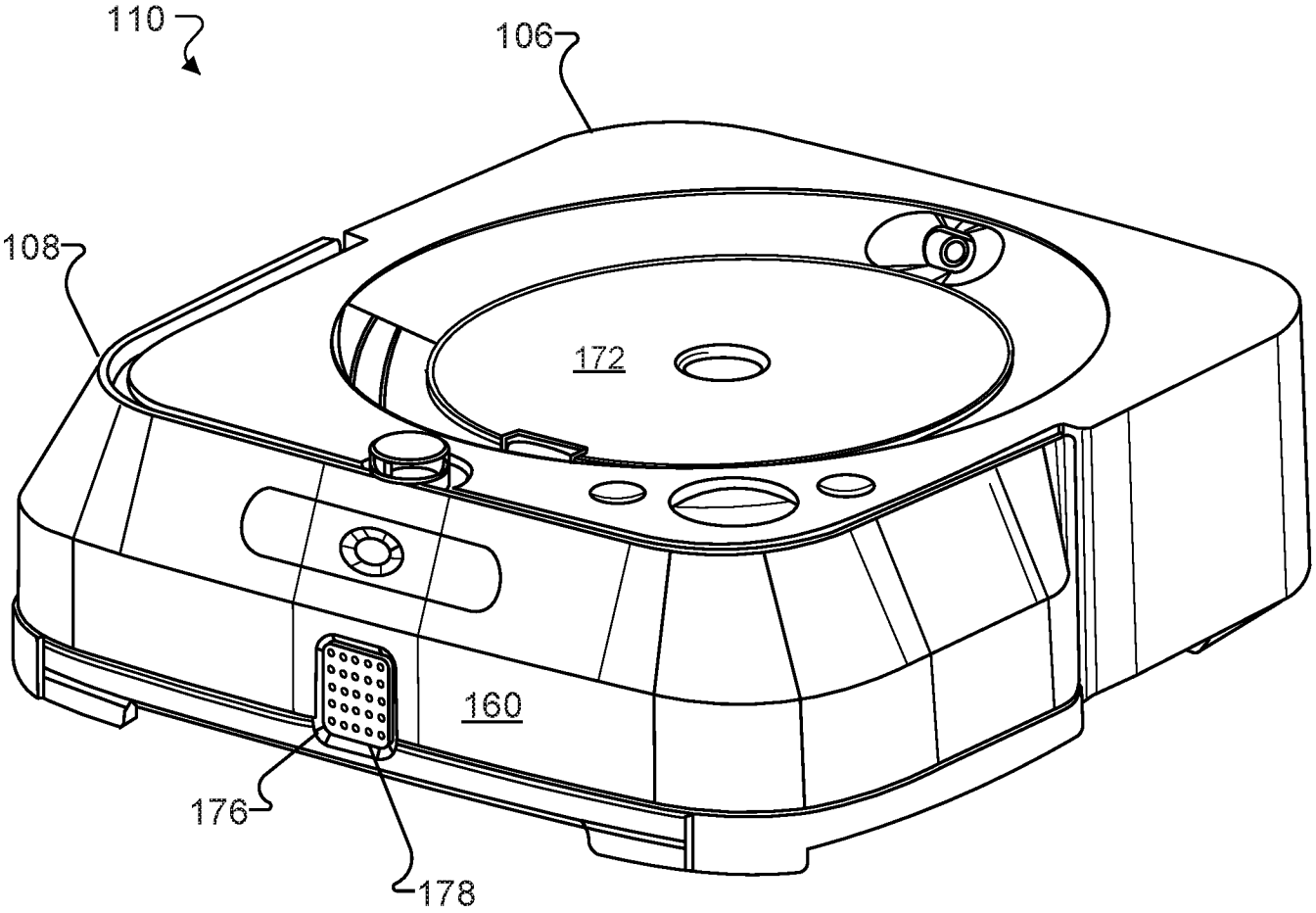
FIG. 12 is a diagram of an autonomous cleaning robot.

Referring to FIG. 12, an autonomous cleaning robot (e.g., the autonomous cleaning robot 110) includes a drive (not shown) that can maneuver the autonomous cleaning robot 110 across the floor surface based on, for example, a drive command having x, y, and θ components.

The forward portion 108 of the autonomous cleaning robot 110 carries a movable bumper 160 for detecting collisions in longitudinal (e.g., forward or rear) or lateral (e.g., left or right) directions.

In some examples, the cleaning pad (not shown) extends beyond the width of the bumper 160 such that the autonomous cleaning robot 110 can position an outer edge of the cleaning pad up to and along tough-to-reach surfaces or into crevices, such as at a wall-floor interface. In some examples, the cleaning pad extends up to the edges and does not extend beyond a pad holder (not shown) of the robot. In such examples, the cleaning pad can be bluntly cut on the ends and absorbent on the side surfaces. The autonomous cleaning robot 110 can push the edge of the cleaning pad against wall surfaces. The position of the cleaning pad further allows the cleaning pad to clean the surfaces or crevices of a wall by the extended edge of the cleaning pad while the autonomous cleaning robot 110 moves in a wall following motion. The extension of the cleaning pad 100 thus enables the autonomous cleaning robot 110 to clean in cracks and crevices.

A reservoir 172 within the body 152 holds a cleaning fluid (e.g., cleaning solution, water, and/or detergent). The autonomous cleaning robot 110 has a fluid applicator 176 connected to the reservoir 172 by a tube. The fluid applicator 176 can be a sprayer or spraying mechanism including a one or more nozzles 178. In some examples of the fluid applicator 176, multiple nozzles are configured to spray fluid in different directions. The fluid applicator may apply fluid downward through a bottom portion of the bumper 160 rather than outward, dripping or spraying the cleaning fluid directly in front of the autonomous cleaning robot 110. In some examples, the fluid applicator is a microfiber cloth or strip, a fluid dispersion brush, or a sprayer. In some examples, the autonomous cleaning robot 110 includes a single nozzle.

The cleaning pad and autonomous cleaning robot 110 are sized and shaped such that the process of transferring the cleaning fluid from the reservoir 172 to the absorptive cleaning pad maintains the forward and aft balance of the autonomous cleaning robot 110 during dynamic motion. The fluid is distributed so that the autonomous cleaning robot 110 continually propels the cleaning pad over the floor surface without the increasingly saturated cleaning pad and decreasingly occupied fluid reservoir 172 lifting the rear portion 106 of the autonomous cleaning robot 110 and pitching the forward portion 108 of the autonomous cleaning robot 110 downward, which can apply movement-prohibitive downward force to the autonomous cleaning robot 110. Thus, the autonomous cleaning robot 110 is able to move the cleaning pad across the floor surface even when the cleaning pad is fully saturated with fluid and the reservoir is empty. The autonomous cleaning robot 110 can track the amount of floor surface traveled and/or the amount of fluid remaining in the reservoir 172, and provide an audible and/or visible alert to a user to replace the cleaning pad and/or to refill the reservoir 172. In some implementations, the autonomous cleaning robot 110 stops moving and remains in place on the floor surface if the cleaning pad is fully saturated or otherwise needs to be replaced, if there remains floor to be cleaned.

The robots and techniques described herein, or portions thereof, can be controlled by a computer program product that includes instructions that are stored on one or more non-transitory machine-readable storage media, and that are executable on one or more processing devices to control (e.g., to coordinate) the operations described herein. The robots described herein, or portions thereof, can be implemented as all or part of an apparatus or electronic system that can include one or more processing devices and memory to store executable instructions to implement various operations.

Operations associated with implementing all or part of the robot operation and control described herein can be performed by one or more programmable processors executing one or more computer programs to perform the functions described herein. For example, the mobile device, a cloud computing system configured to communicate with the mobile device and the autonomous cleaning robot, and the robot's controller may all include processors programmed with computer programs for executing functions such as transmitting signals, computing estimates, or interpreting signals. A computer program can be written in any form of programming language, including compiled or interpreted languages, and it can be deployed in any form, including as a stand-alone program or as a module, component, subroutine, or other unit suitable for use in a computing environment.

The controllers and mobile devices described herein can include one or more processors. Processors suitable for the execution of a computer program include, by way of example, both general and special purpose microprocessors, and any one or more processors of any kind of digital computer. Generally, a processor will receive instructions and data from a read-only storage area or a random access storage area or both. Elements of a computer include one or more processors for executing instructions and one or more storage area devices for storing instructions and data. Generally, a computer will also include, or be operatively coupled to receive data from, or transfer data to, or both, one or more machine-readable storage media, such as mass PCBs for storing data, e.g., magnetic, magneto-optical disks, or optical disks. Machine-readable storage media suitable for embodying computer program instructions and data include all forms of non-volatile storage area, including by way of example, semiconductor storage area devices, e.g., EPROM, EEPROM, and flash storage area devices; magnetic disks, e.g., internal hard disks or removable disks; magneto-optical disks; and CD-ROM and DVD-ROM disks.

The robot control and operating techniques described herein may be applicable to controlling other mobile robots aside from cleaning robots. For example, a lawn mowing robot or a space-monitoring robot may be trained to perform operations in specific portions of a lawn or space as described herein.

Elements of different implementations described herein may be combined to form other implementations not specifically set forth above. Elements may be left out of the structures described herein without adversely affecting their operation. Furthermore, various separate elements may be combined into one or more individual elements to perform the functions described herein.

What is claimed is:

1. A cleaning pad for an autonomous cleaning robot, wherein the autonomous cleaning robot is for cleaning debris from a floor surface, the cleaning pad comprising:

a mounting surface disposed on a top side of the cleaning pad, the mounting surface configured to provide a mechanical connection to an autonomous cleaning robot;

a first outer layer disposed on a bottom side of the cleaning pad, the first outer layer having a first coefficient of friction between a material of the first outer layer and a material of the debris; and a second outer layer disposed on the bottom side of the cleaning pad, the second outer layer having a second coefficient of friction between a material of the second outer layer and the material of the debris, wherein the second coefficient of friction is less than the first coefficient of friction, and wherein the second outer layer is positioned forward of the first outer layer in a configuration wherein the cleaning pad is attached to the autonomous cleaning robot, and wherein the second coefficient of friction is less than a third coefficient of friction between the material of the debris and a material of the floor surface, and wherein the cleaning pad is configured to mitigate the accumulation of debris underneath one or more sensors of the autonomous cleaning robot at or near a leading edge of the cleaning pad, and wherein during operation of the autonomous cleaning robot, the second outer layer slips over the debris that has the third coefficient of friction with the floor surface and the first outer layer collects the debris that has the third coefficient of friction with the floor surface.

2. The cleaning pad of claim 1, in which a surface area of the first outer layer is larger than a surface area of the second outer layer.

3. The cleaning pad of claim 2, in which a ratio of the surface area of the first outer layer to the surface area of the second outer layer is between 1:1 and 10:1.

4. The cleaning pad of claim 1, in which the second outer layer is disposed forward of at least a portion of the first outer layer.

5. The cleaning pad of claim 1, in which a forward portion of the cleaning pad is angled relative to a rear portion of the cleaning pad.

6. The cleaning pad of claim 5, in which an angle between the forward portion of the pad and the rear portion of the pad is between 30° and 60°.

7. The cleaning pad of claim 1, in which the second outer layer comprises a layer of material wrapped around a forward edge of the cleaning pad.

8. The cleaning pad of claim 1, comprising a core, in which the mounting surface is disposed on a top surface of the core and the first and second outer layers are disposed on a bottom surface of the core.

9. The cleaning pad of claim 8, in which the first outer layer comprises a layer of material wrapped around the core.

10. The cleaning pad of claim 8, in which the first outer layer is disposed directly on the bottom surface of the core, and the second outer layer is disposed on a forward portion of the first outer layer.

11. The cleaning pad of claim 8, in which the first outer layer is disposed directly on a rear portion of the bottom surface of the core, and the second outer layer is disposed directly on a forward portion of the bottom surface of the core.

12. The cleaning pad of claim 1, in which the second outer layer comprises a polymer.

13. The cleaning pad of claim 12, in which the second outer layer comprises a polymer layer having a release coating.

14. The cleaning pad of claim 1, in which the second outer layer comprises a tape.

15. The cleaning pad of claim 1, in which the second outer layer comprises a thin film coating.

16. The cleaning pad of claim 1, in which the second outer layer comprises a folded layer of material.

17. The cleaning pad of claim 16, in which the folded layer of material of the second outer layer defines a rear-facing opening.

18. The cleaning pad of claim 1, in which the second outer layer spans an entire width of the cleaning pad.

19. The cleaning pad of claim 1, in which a thickness of a forward segment of the cleaning pad is greater than a thickness of a rear segment of the cleaning pad.

20. The cleaning pad of claim 1, in which a depression is defined in a bottom surface of the cleaning pad to a rear of the second outer layer.

21. The cleaning pad of claim 1, in which the second coefficient of friction is less than half of the first coefficient of friction.

22. The cleaning pad of claim 1, wherein the first coefficient of friction between the material of the first outer layer and the material of the debris is greater than the third coefficient of friction between the material of the debris and the material of the floor surface.

23. The cleaning pad of claim 1, wherein the debris comprises at least one of a dust bunny or pet hair.

24. The cleaning pad of claim 1, wherein the material of the first outer layer is distinct from the material of the second outer layer.

25. An autonomous cleaning robot for cleaning debris from a floor surface, comprising:

a robot body comprising a forward portion and a rear portion;

a drive system to maneuver the robot body across the floor surface;

a cleaning assembly affixed to the forward portion of the robot body, the cleaning assembly comprising a pad holder; and a cleaning pad affixed to the pad holder of the cleaning assembly by a mounting surface of the cleaning pad, the mounting surface of the cleaning pad disposed on a top side of the cleaning pad, in which the cleaning pad comprises:

a first outer layer disposed on a bottom side of the cleaning pad, the first outer layer having a first coefficient of friction between a material of the first outer layer and a material of the debris; and a second outer layer disposed on the bottom side of the cleaning pad, the second outer layer having a second coefficient of friction between a material of the second outer layer and the material of the debris, wherein the second coefficient of friction is less than the first coefficient of friction, and wherein the second outer layer is positioned forward of the first outer layer in a configuration wherein the cleaning pad is affixed to the pad holder of the cleaning assembly, and wherein the second coefficient of friction is less than a third coefficient of friction between the material of the debris and a material of the floor surface, and wherein the cleaning pad is configured to mitigate the accumulation of debris underneath one or more sensors of the autonomous cleaning robot at or near a leading edge of the cleaning pad, and wherein during operation of the autonomous cleaning robot, the second outer layer slips over the debris that has the third coefficient of friction with the floor surface and the first outer layer collects the debris that has the third coefficient of friction with the floor surface.

26. The autonomous cleaning robot of claim 25, in which a leading edge of the cleaning pad is aligned with a leading edge of the robot body.

27. The autonomous cleaning robot of claim 25, in which a surface area of the first outer layer of the cleaning pad is larger than a surface area of the second outer layer.

28. The autonomous cleaning robot of claim 25, in which the second outer layer of the cleaning pad is disposed forward of at least a portion of the first outer layer.

29. The autonomous cleaning robot of claim 25, in which a forward portion of the cleaning pad is angled relative to a rear portion of the cleaning pad.

30. The autonomous cleaning robot of claim 25, in which the second outer layer comprises a layer of material wrapped around a forward edge of the cleaning pad.

31. The autonomous cleaning robot of claim 25, in which the cleaning pad comprises a core, in which the mounting surface is disposed on a top surface of the core and the first and second outer layers are disposed on a bottom surface of the core.

32. The autonomous cleaning robot of claim 31, in which the first outer layer is disposed directly on the bottom surface of the core, and the second outer layer is disposed on a forward portion of the first outer layer.

33. The autonomous cleaning robot of claim 25, in which the second coefficient of friction is less than half of the first coefficient of friction.

* * * * *